United States Patent [19]

Souders

[11] Patent Number: 4,505,479

[45] Date of Patent: Mar. 19, 1985

[54] WEIGHTED BAT WITH WEIGHT SECURING MEANS

[76] Inventor: Roger B. Souders, 10180 Eagle Rock Ave., San Diego, Calif. 92126

[21] Appl. No.: 437,953

[22] Filed: Dec. 28, 1982

[51] Int. Cl.[3] ..... A63B 59/06

[52] U.S. Cl. ..... 273/72 A; 411/166; 220/200; 220/288; 273/DIG. 23

[58] Field of Search ..... 273/72 R, 72 A, 80.2–80.9, 273/73 J, 75; 403/299, 354, 287, 296; 16/118, 121, DIG. 3; 411/166, 175, 177, 180, 187; 220/200, 288

[56] References Cited

U.S. PATENT DOCUMENTS

| | | | |
|---|---|---|---|
| 1,026,990 | 5/1912 | Matson | 273/72 R |
| 1,603,904 | 10/1926 | Cohn | 273/72 R |
| 1,611,858 | 12/1926 | Middlekauf | 273/72 R |
| 1,665,195 | 4/1928 | Cohn | 273/72 R |
| 3,397,889 | 8/1968 | Smith | 273/82 R |
| 3,972,528 | 8/1976 | McCracken et al. | 273/72 A |

FOREIGN PATENT DOCUMENTS

| | | | |
|---|---|---|---|
| 1424506 | 12/1965 | France | 273/72 A |

OTHER PUBLICATIONS

The Sporting Goods Dealer, Nov. 1972, p. 33.

*Primary Examiner*—Richard C. Pinkham
*Assistant Examiner*—Matthew L. Schneider
*Attorney, Agent, or Firm*—Thomas J. Tighe

[57] ABSTRACT

A shell forming the walls of a bat comprising a striking portion, an intermediate portion and a handle portion. The shell is filled with structural foam. The striking portion is closed by a weighted cap and the handle portion is closed by a knob. The cap and knob are secured to the shell by stud or by a connecting rod. The stud receiving device has a plurality of fins which extend outwardly therefrom. The fins fit in corresponding slots formed in either end of the bat. The stud receiving device is internally threaded as are the cap and knob. A threaded stud is then used to secure the cap and knob to their respective ends. The shell is over-wrapped with woven or braided composite-type materials, such as graphite, KEVLAR, glass and boron.

6 Claims, 1 Drawing Figure

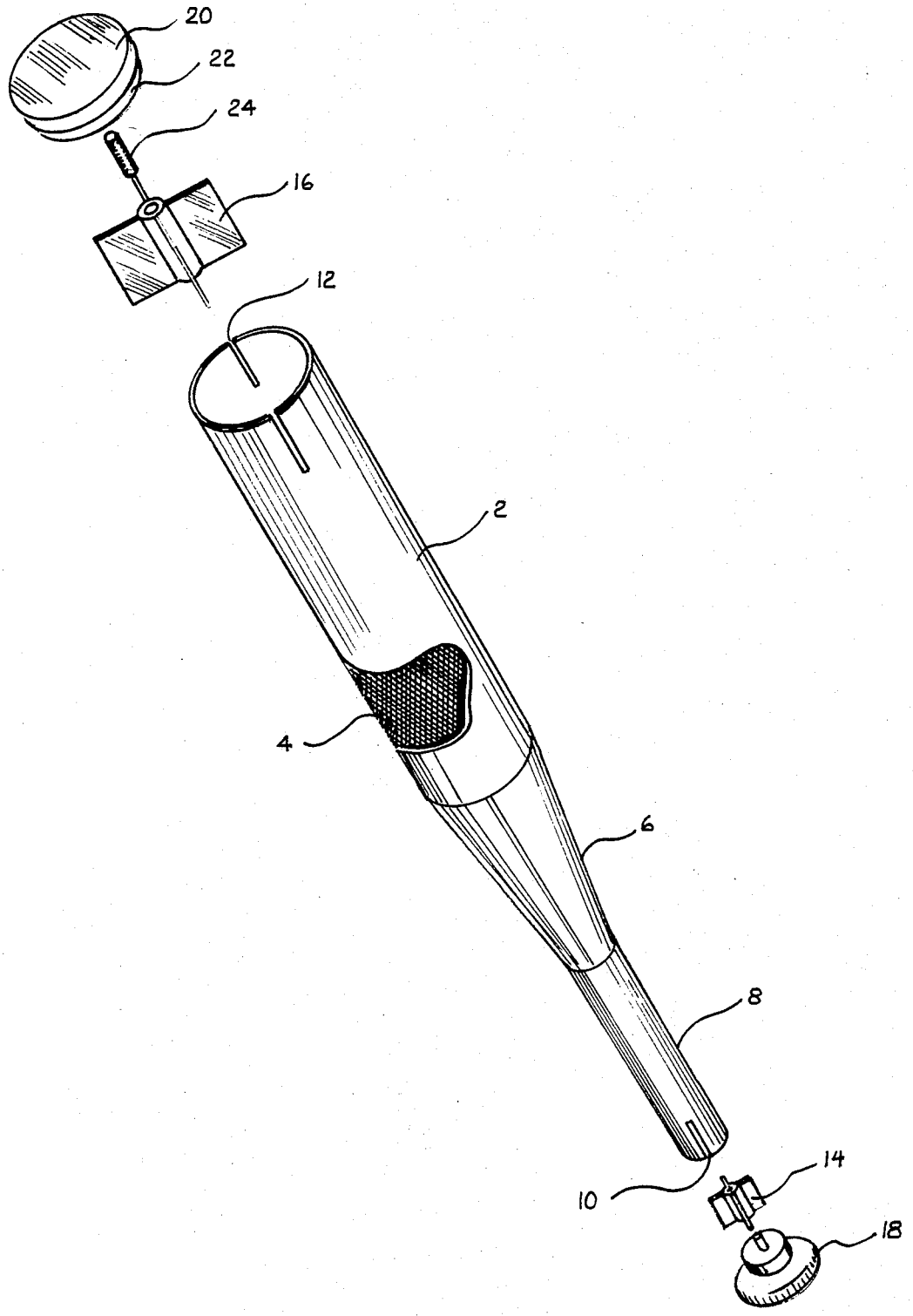
20
22
24
16
12
2
4
6
8
10
14
18

WEIGHTED BAT WITH WEIGHT SECURING MEANS

BACKGROUND OF THE INVENTION

This invention relates to baseball and softball bats in general and to metal bats in particular.

This invention presents an improved aluminum bat. The improvements are primarily due to its novel construction whereby the functional parts are minimized and easily manufactured. Interior foam, which aids in the structural resilience of the bat, reduces the necessary thickness of the aluminum walls of the bat. Furthermore, the weight of the bat is easily adjusted.

Other advantages and attributes of this invention will become apparent upon the reading of the text hereinafter.

SUMMARY

The walls of the bat are a single aluminum shell having three (3) portions: (1) a handle portion, (2) a striking portion, and (3) an intermediate portion. The striking portion is, of course, larger in cross-sectional diameter than the handle portion and the intermediate portion is integral with and joins the other two portions. The shell is filled with a suitable foam which aids in the structural resilience of the bat. A weighted cap closes the striking portion of the bat and a knob closes the handle portion of the bat. The cap and the knob are secured to the shell preferably by threaded stud means. The weight of the bat is adjustable by changing the density of the interior foam, the weight of the cap, or both. The bat is over-wrapped with a composite-type material such as woven graphite, KEVLAR, glass, and boron.

An object of this invention is to provide an improved metal bat using interior foam as structural support of a metal shell.

A further object of this invention is to provide a bat the weight of which is easily adjustable.

Other objects of this invention will become apparent upon a reading of the text hereinafter.

BRIEF DESCRIPTION OF THE DRAWINGS

FIG. 1 is an exploded view of the invention with a portion of the bat cut away exposing interior foam.

DESCRIPTION OF THE PREFERRED EMBODIMENT

Referring to the FIGURE, the walls of the bat are shown to be a single shell having a striking portion 2 which is filled with a suitable foam 4. The striking portion 2 is joined by an intermediate portion 6 to a handle portion 8. The three (3) portions are integral parts of the shell. The shell is preferably metal spun aluminum tubing with a wall thickness of 0.050 inches or less. At the open end of the handle portion 8, are a plurality of longitudinal slots 10 defined by said handle portion. At the open end of the striking portion 2 are a plurality of similar longitudinal slots 12 which are defined by said striking portion. A threaded stud receiving means 14 mates with the open end of the handle portion 8. As can be seen, the stud receiving means is a cylindrical tube with a threaded bore with radially extending fins, the cylindrical tube being a central piece from which the fins extend. The fins are disposed within corresponding slots 10 and are affixed to the shell by welding. An identical but larger stud receiving means 16 mates with the slots of the open end of the striking portion 2. A knob means 18 with a threaded stud protruding centrally therefrom screws into the stud receiving means 14 to close the handle portion 8. The knob means is used primarily to keep a batter's hands from slipping from the handle portion while the bat is being swung.

A disc-like cap means 20 has a reduced diameter portion 22 and is adaptable to mate with the open end of the striking portion and be secured thereto by means of a threaded stud 24. Since the shell is manufactured of thin, light weight aluminum and is filled with a light weight foam, it is the cap means 20 which primarily imparts weight the bat. This is very advantageous to a batter because the majority of the weight of the bat is at the end of the lever which is the shell, and thus, more angular momentum can be imparted to the ball when it is struck for an equally forceful swing. The weight of the bat can be easily adjusted by changing the weight of the cap means 20, by varying the density of the foam 4 or both.

The bat is over-wrapped with a composite type material, such as graphite, KEVLAR, glass, or boron, using a braiding or hand laid-up method. Thus the composite-type material as it is affixed to the exterior of the shell is woven.

As an alternative means of securing the cap means 20 and the knob means 18 to the shell, a connecting rod (not shown) which passes through the center of the shell and the center of the foam with one end proximate to the open end of the striking portion and the other end proximate to the open end of the handle portion, can be used to mate with rod receiving bores defined by the cap means 20 and the knob means 18, respectively. Thus, in the second configuration, the connecting rod would replace the studs and the stud receiving means 14 and 16.

The foregoing description was given for illustrative purposes only and no unnecessary limitations in the claims which follow should be drawn therefrom.

I claim:

1. A bat comprising:

(a) an elongated aluminum shell having a handle portion, an intermediate portion and a striking portion, the handle portion being suitable for gripping, the striking portion being suitably larger in diameter than the handle portion, and the intermediate portion being integral with and joining the handle portion and the striking portion, (b) a cap means for closing the striking portion and for imparting a desired weight to the bat, (c) means for securing the cap means to the shell, (d) a knob means for closing the handle portion and for preventing the bat from unintentionally slipping through the hands of a batter, (e) a stud receiving means disposed at the open end of the handle portion, (f) a stud means for securing the knob means to the stud receiving means, (g) a plurality of fins extending radially outward from the stud receiving means, and (h) a plurality of slots defined by the shell and located at the handle portion of the shell, said fins being secured in said slots.

2. A bat comprising:

(a) an elongated aluminum shell having a handle portion, an intermediate portion and a striking portion, the handle portion being suitable for gripping, the striking portion being suitably larger in diameter than the handle portion, and the intermediate portion being integral with and joining the handle portion and the striking portion, (b) a cap means for closing the striking portion and for imparting a desired weight to the bat, (c) a stud receiving means disposed at the end of the striking portion, (d) a stud means for securing the cap means to the stud receiving means, (e) a plurality of fins extending radially outward from the stud receiving means, (f) a plurality of slots defined by the shell and located at the striking portion of the shell, said fins being secured in said slots, (g) a knob means for closing the handle portion and for preventing the bat from unintentionally slipping through the hands of batter, and (h) means for securing the knob means to the shell.

3. The bat of claim 2 wherein the knob securing means comprises:

(a) a second stud receiving means disposed at the end of the handle portion, (b) a stud means for securing the knob means to the second stud receiving means, (c) a plurality of fins extending radially outward from the second stud receiving means, and (d) a plurality of slots defined by the shell and located at the handle portion of the shell, said fins of said second stud receiving means being secured in said slots.

4. The bat of claim 2, 1, or 3 further comprising an over-wrapping of woven or braided composite-type material for strengthening the shell.

5. The bat of claim 2, 1, or 3 further comprising a foam means disposed within and substantially filling the shell, the foam being a structural part of the shell.

6. The bat of claim 5 further comprising an over-wrapping of woven or braided composite-type material for strengthening the shell.

* * * * *